United States Patent [19]

Asao et al.

[11] Patent Number: 4,605,612

[45] Date of Patent: Aug. 12, 1986

[54] SUPPORT FOR PHOTOGRAPHIC PAPER HAVING ELECTRON BEAM CURED RESIN LAYER

[75] Inventors: Yasuzi Asao; Takashi Takayanagi, both of Shizuoka, Japan

[73] Assignee: Fuji Photo Film Co., Ltd., Kanagawa, Japan

[21] Appl. No.: 706,354

[22] Filed: Feb. 27, 1985

[30] Foreign Application Priority Data

Feb. 27, 1984 [JP] Japan ..... 59-35736

[51] Int. Cl.[4] ..... G03C 1/76

[52] U.S. Cl. ..... 430/538; 430/271; 430/536; 427/35; 427/44; 428/512; 162/136; 162/168.1; 162/192

[58] Field of Search ..... 430/296, 538, 271, 536; 527/35, 44; 162/136, 168.1, 197; 528/512

[56] References Cited

U.S. PATENT DOCUMENTS 4,309,486 1/1982 Sack et al. ..... 427/44

4,364,971 12/1982 Sack et al. ..... 427/362

4,384,040 5/1983 von Meer ..... 430/558

*Primary Examiner*—Jack P. Brammer

*Attorney, Agent, or Firm*—Sughrue, Mion, Zinn, Macpeak & Seas

[57] ABSTRACT

A support for photographic paper is described, which comprises a sheet of paper coated with a composition comprising an unsaturated bond-containing electron beam-polymerizable organic compound and an inorganic white pigment that is subjected to electron beam irradiation for curing, wherein said unsaturated bond-containing organic compound (A) and said inorganic white pigment (B) are present in a weight ratio (A)/(B) of from 3/1 to 1/9, and said unsaturated bond-containing organic compound comprises an unsaturated organic compound (C) containing two carbon-to-carbon double bonds per molecule and an unsaturated organic compound (D) containing three carbon-to-carbon double bonds per molecule, and the weight ratio (C)/(D) is from 49/51 to 1/99.

5 Claims, No Drawings

SUPPORT FOR PHOTOGRAPHIC PAPER HAVING ELECTRON BEAM CURED RESIN LAYER

FIELD OF THE INVENTION

This invention relates to a support for photographic paper. More particularly, the invention relates to a support for photographic paper which has improved resistance to the permeation of aqueous solutions for photographic processing.

BACKGROUND OF THE INVENTION

In manufacturing a support for photographic paper which comprises a paper support, it is generally necessary to treat the support in one way or another so as to render the paper impermeable to water, developing agents, and auxiliaries. A method generally used for this purpose comprises overcoating the paper with a barrier layer comprising a polymer, such as a polyolefin (e.g., polyethylene) layer. When this method is used, the coated layer should preferably be as thin as possible from the viewpoints of increased productivity and reduced cost. For such thin layer coatings, however, high temperature melting of polyolefin is required. Since polyolefins are thermally decomposable, said high temperature melting tends to disadvantageously result in yellowing or pinhole formation on the coated surface. Moreover, this method does not allow the use of increased amounts of white pigments for the purpose of increasing the hiding power, since volatile matter contained in the white pigments causes foaming in the step of extrusion, or improper dispersion results. For such reasons, photographic prints high in resolving power cannot be obtained.

Recent attempts to overcome the above disadvantages involves coating a paper support with a composition which contains an unsaturated bond-containing organic compound polymerizable upon electron beam irradiation and a high concentration of an inorganic white pigment and then irradiating the thus-coated support with electron beams for curing, as described in Japanese Patent Application (OPI) Nos. 27257/82 (corresponding to U.S. Pat. No. 4, 384,040) and 49946/82 (the term "OPI" as used herein refers to a "published unexamined Japanese patent application").

However, the methods disclosed in the above-cited patent specifications have either of the following drawbacks, although tending to overcome the disadvantages mentioned above.

(1) Yellowing of the support after developement occurs, which is due to retention by adsorption of chemicals used for photographic developement processing;

(2) formation of cracks occur on the surface of the support upon the bending of the support.

The above drawbacks (1) and (2) are contrary to each other and the prior art can hardly overcome both of them simultaneously. The photographic paper in which such support is used is therefore not totally satisfactory.

SUMMARY OF THE INVENTION

An object of the invention is to provide a support for photographic paper which is free of yellowing after developement, resistant to cracking on the surface thereof upon bending, and high in resolving power.

In accordance with the present invention, the above object can be achieved by coating a paper support with a composition comprising an unsaturated bond-containing electron beam-polymerizable organic compound and an inorganic white pigment that is subjected to electron beam irradiation for curing, wherein said unsaturated bond-containing organic compound (A) and said inorganic white pigment (B) are present in a weight ratio (A)/(B) of from 3/1 to 1/9, and said unsaturated bond-containing organic compound comprises an unsaturated organic compound (C) containing two carbon-to-carbon double bonds per molecule and an unsaturated organic compound (D) containing three carbon-to-carbon double bonds per molecule in a weight ratio (C)/(D) of from 49/51 to 1/99.

DETAILED DESCRIPTION OF THE INVENTION

The unsaturated organic compound containing two carbon-to-carbon double bonds per molecule and capable of polymerizing upon electron beam irradiation which is to be used in practicing the invention, includes, among others, diacrylates and dimethacrylates of the ester, ether, epoxy, and urethane types. Among them particularly preferred are ether-type diacrylates represented by formula (I)

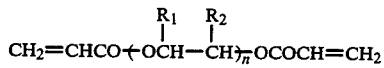

(I)

In formula (I), $R_1$ and $R_2$ each represents —H, —OH, an alkyl group containing from 1 to 6 carbon atoms or an alkoxy group containing from 1 to 6 carbon atoms, or an aryl group, and n is 1 to 15.

Among the compounds of formula (I) preferred at those in which $R_1$ and $R_2$ are each —H, $—CH_3$, $—C_2H_5$, $—C_4H_9$, $—C_5H_{11}$, or a phenyl group, and n is 1 to 5.

The unsaturated organic compound containing three carbon-to-carbon double bonds per molecule includes, among others, triacrylates and trimethacrylates of the ester, ether, epoxy, and urethane types. Particularly preferred among them are ether-type triacrylates represented by formula (II)

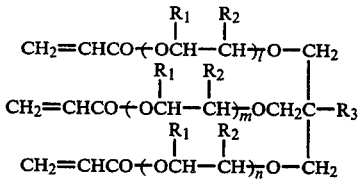

(II)

In formula (II), $R_1$, $R_2$, and $R_3$ each represents —H, —OH, $—CH_2OH$, and alkyl group containing from 1 to 6 carbon atoms, or an alkoxy group containing from 1 to 6 carbon atoms, or an aryl group, and l+m+n is from 1 to 20.

Preferred compounds represented by formula (II) include those in which $R_1$, $R_2$, and $R_3$ each represents —H, $—CH_2OH$, $—CH_3$, $—C_2H_5$, $—C_4H_9$, $—C_5H_{11}$, or a phenyl group, and l+m+n is from 2 to 9.

Examples of the compound represented by formula (I) are set forth below. However, the compounds to be used in accordance with the present invention are by no means limited to such examples.

In the exemplification, the following abbreviations for the alkylene oxides are used.

E.O is used for $$-CH_2\overset{\overset{H}{|}}{C}H-O-;$$

P.O is used for $$-CH_2\overset{\overset{CH_3}{|}}{C}H-O-;$$

B.O is used for $$-CH_2\overset{\overset{CH_2CH_3}{|}}{C}H-O-;$$

and

S.O is used for

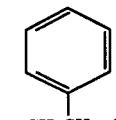

$$-CH_2CH-O-.$$

Where the alkylene oxide involves isomers, such isomers and mixtures thereof are all usable in the practice of the invention.

| | | |
|---|---|---|
| (I-i) | $CH_2{=}CHCO(E.O)_nOCOCH{=}CH_2$ | n = 2, 3, 4, 5 |
| (I-ii) | $CH_2{=}CHCO(P.O)_nOCOCH{=}CH_2$ | n = 2, 3, 4, 5 |
| (I-iii) | $CH_2{=}CHCO(B.O)_nOCOCH{=}CH_2$ | n = 2, 3, 4, 5 |
| (I-iv) | $CH_2{=}CHCO(S.O)_nOCOCH{=}CH_2$ | n = 2, 3, 4, 5 |

The foregoing are typical principal components in respective mixtures of compounds differing in the number of n.

Examples of the compounds represented by formula (II), which are, again, by no means limitative of the scope of the present invention, are set forth below, the abbreviations for alkylene oxides being the same as above.

Where the alkylene oxide involves isomers, the alkylene oxide to be used in the practice of the invention includes such isomers and mixtures thereof.

| | | |
|---|---|---|
| (II-i) | $CH_2{=}CHCO{-}(E.O)_l{-}OCH_2$<br>$CH_2{=}CHCO{-}(E.O)_m{-}OCH_2C{-}CH_2CH_3$<br>$CH_2{=}CHCO{-}(E.O)_n{-}OCH_2$ | l + m + n = 3, 4, 5 |
| (II-ii) | $CH_2{=}CHCO{-}(E.O)_l{-}OCH_2$<br>$CH_2{=}CHCO{-}(E.O)_m{-}OCH_2C{-}CH_2OH$<br>$CH_2{=}CHCO{-}(E.O)_n{-}OCH_2$ | l + m + n = 3, 4, 5 |
| (II-iii) | $CH_2{=}CHCO{-}(P.O)_l{-}OCH_2$<br>$CH_2{=}CHCO{-}(P.O)_m{-}OCH_2C{-}CH_2CH_3$<br>$CH_2{=}CHCO{-}(P.O)_n{-}OCH_2$ | l + m + n = 3, 4, 5 |
| (II-iv) | $CH_2{=}CHCO{-}(P.O)_l{-}OCH_2$<br>$CH_2{=}CHCO{-}(P.O)_m{-}OCH_2C{-}CH_2OH$<br>$CH_2{=}CHCO{-}(P.O)_n{-}OCH_2$ | l + m + n = 3, 4, 5 |

-continued

| | | |
|---|---|---|
| (II-v) | $CH_2{=}CHCO{-}(B.O)_l{-}OCH_2$<br>$CH_2{=}CHCO{-}(B.O)_m{-}OCH_2C{-}CH_2CH_3$<br>$CH_2{=}CHCO{-}(B.O)_n{-}OCH_2$ | l + m + n = 3, 4, 5 |
| (II-vi) | $CH_2{=}CHCO{-}(B.O)_l{-}OCH_2$<br>$CH_2{=}CHCO{-}(B.O)_m{-}OCH_2C{-}CH_2OH$<br>$CH_2{=}CHCO{-}(B.O)_n{-}OCH_2$ | l + m + n = 3, 4, 5 |
| (II-vii) | $CH_2{=}CHCO{-}(S.O)_l{-}OCH_2$<br>$CH_2{=}CHCO{-}(S.O)_m{-}OCH_2C{-}CH_2CH_3$<br>$CH_2{=}CHCO{-}(S.O)_n{-}OCH_2$ | l + m + n = 3, 4, 5 |
| (II-viii) | $CH_2{=}CHCO{-}(S.O)_l{-}OCH_2$<br>$CH_2{=}CHCO{-}(S.O)_m{-}OCH_2C{-}CH_2OH$<br>$CH_2{=}CHCO{-}(S.O)_n{-}OCH_2$ | l + m + n = 3, 4, 5 |

The foregoing are typical principal components in respective mixtures of compounds differing in the value of (l+m+n).

The unsaturated organic compound (C) containing two carbon-to-carbon double bonds per molecule and the unsaturated organic compound (D) containing three carbon-to-carbon double bonds per molecule are used in a weight ratio, (C)/(D), of from 49/51 to 1/99, preferably from 45/55 to 5/95, and more preferably from 40/60 to 20/80. A support in which said ratio is greater than 49/51 or smaller than 1/99 is not suited for use in photographic paper manufacture because, of coloring after developing treatment or cracking, respectively.

Examples of the inorganic white pigment which are usable in the practice of the invention include $TiO_2$, ZnO, $SiO_2$, $BaSO_4$, $CaSO_4$, $CaCO_3$, talc and clay. Any other inorganic white pigments, however, may also be used.

$TiO_2$ materials coated with various organic or inorganic compounds are preferably used for the purpose of obtaining improved dispersibility of such inorganic white pigments or improved resistance to yellowing with time. The other known inorganic white pigment materials are all usable.

The inorganic white pigment to be used in preparing the coating composition according to the invention has an average grain size greater than 0.1 μm, and preferably greater than 0.15 μm. Grain sizes not greater than 0.1 μm in diameter tend to be incapable of producing the desired improvement in resolving power.

The unsaturated bond-containing organic compound (A), which is a mixture of the compounds (C) and (D), and the inorganic white pigment (B) are used in a weight ratio, (A)/(B), of from 3/1 to 1/9, and preferably from 2/1 to ¼. When the ratio (A)/(B) is greater than 4/1 by weight, a satisfactory resolving power cannot be obtained. When said ratio is smaller than 1/9, pinholes or the like defects occur, and consequently a satisfactory coat film cannot be obtained.

To adjust the viscosity of the coating composition and thereby improve the coating ability (coatability), an organic solvent may be added to the above coating composition. The organic solvent may appropriately be selected from among ketones such as acetone, methyl ethyl ketone, methyl isobutyl ketone and cyclohexanone; esters such as methyl acetate, ethyl acetate, butyl acetate, ethyl lactate and glycol monoethyl ether acetate; ether and glycol ethers such as glycol dimethyl ether, glycol monoethyl ether and dioxane; tar-derived or aromatic hydrocarbons such as benzene, toluene and xylene; and chlorinated hydrocarbons such as methylene chloride, ethylene chloride, carbon tetrachloride, chloroform, ethylene chlorohydrin, and dichlorobenzene.

Furthermore, the following resins which are incapable of curing upon electron beam irradiation, when blended in with the coating composition, may be used to provide flexibility and/or heat resistance:

Cellulose esters;
Polyvinyl butyral;
Polyvinyl acetate and vinyl acetate copolymers;
Saturated or unsaturated, sytrene-free polyester resins;
Styrene-acrylate resins; and
Polystyrene resins.

Pigments capable of giving blue, violet, or red tints are often added to the white-colored mixture, since such pigments generally strengthen the impression of the white color of a layer. As such pigments, there may be used for instance, inorganic colored pigments such as ultramarine, cobalt blue, cobalt violet and cadmium red, and organic colored pigments such as phthalocyanine blue.

The paper support to be used in the practice of the invention is made of a natural pulp (e.g., soft wood pulp, hardwood pulp) or a mixture of natural pulp and synthetic pulp, which is the principal component and which is beaten to 200 to 400 CSF, with various sizes, reinforcements, fillers, fixing aids, and so forth added as necessary. The support generally has a thickness of from 50 to 300 microns.

When a paper support coated with a polyolefin (e.g., polyethylene, polypropylene) is used, a photographic paper support better in smoothness and free of pinholes can be obtained.

In kneading the composition for achieving dispersion, various types of kneading apparatus are usable. Thus, for instance, two-roll mills, three-roll mills, ball mills, pebble mills, trommels, sand grinders, Szegvari attriter, high-speed impeller dispersers, high-speed stone mills, high-speed impact mills, dispersion mills, kneaders, high-speed mixers, homogenizers, and sonicators (ultrasonic dispersing machine).

Techniques of kneading and dispersing are described, e.g., in T.C. Patton, *Paint Flow and Pigment Dispersion*, published by John Wiley & Sons, Inc. (1964), and also in U.S. Pat. Nos. 2,581,414 and 2,855,156.

The support can be coated with the above-mentioned composition by the technique of air doctor coating, blade coating, air knife coating, squeeze coating, impregnating coating, reverse roll coating, transfer roll coating, gravure coating, kiss coating, cast coating, spray coating or spin coating, or by any other appropriate method. For detailed description, refer to *Coating Kogaku* (*Coating Technology*), pages 253–277 (1971, from Asakura Shoten, Tokyo).

The coated layer typically has a thickness of from 3 to 100 microns, and preferably from 5 to 50 microns. Outside this range, uneven coating may result, extra energy is required for curing, or insufficient curing may result, which is unfavorable from the viewpoint of quality.

For increasing the wetting of the paper support with the coated layer as well as the adhesion betwen said support and said coat layer, the paper support may be surface-treated by a corona discharge treatment, for instance, followed by coating with the above-mentioned composition.

As the electron beam accelerator, there may be used a van de Graaff accelerator operated in the scanning method, double scanning method, or curtain beam method, preferably in the curtain beam method in which a large output can be obtained at relatively low cost. Regarding the electron beam characteristics, the accelerating voltage is typically from 100 to 1,000 KV, and preferably from 100 to 300 KV, and the absorption dose is typically from 0.5 to 20 megarads, and preferably from 2 to 10 megarads. If the accelerating voltage is less than 100 KV, the energy transmission will be insufficient, whereas, if the voltage exceeds 1,000 KV, the energy efficiency with respect to the polymerization will become uneconomically low. At an absorption dose of less than 0.5 megarad, the curing reaction will progress only to an insufficient extent, failing to attain the desired quality. An absorption dose exceeding 20 megarads is also unfavorable because of decreased energy efficiency with respect to the curing, or heat generation in the support under irradiation.

The oxygen concentration during irradiation is desirably not higher than 5,000 ppm. When present in a concentration exceeding 5,000 ppm, oxygen will interfere with the reaction, rendering the curing insufficient.

It is possible to smooth the surface by means of a roll having a mirror-finished surface, or to mat-finish the surface with a mat roll such as a woven wire-covered roll, after coating or after curing. For increasing the adhesion of the photosensitive emulsion layer thereto, the coated support may be subjected to a surface treatment, such as a corona discharge treatment, or provision of a subbing layer thereon. An antistatic agent, for instance, may also be added to the composition to be used in accordance with the invention.

The thus-obtained photographic paper support according to this invention does not become colored upon development treatment and is resistant to cracking. The color photographic paper obtained by coating this support with a silver-gelatin color sensitive emulsion followed by drying exhibits a high degree of resolving power, has favorable photographic properties (inclusive of sensitivity, resistance to fogging, etc.) and can give an excellent photographic print having a high degree of gloss.

The following examples illustrate the effects of the invention in more detail. Unless otherwise indicated, all parts, percents, ratio and the like are by weight.

EXAMPLE 1

The following composition was stirred in a ball mill for 20 hours and then coated on a sheet of paper (180 microns in thickness) to a thickness of 20 microns (after drying):

| | |
|---|---|
| Titanium dioxide in anatase form | 50 parts by weight |
| Ether-type diacrylate represented by the formula $CH_2{=}CHCO{\leftarrow}OC_3H_6{\rightarrow}_3OCOCH{=}CH_2$ | 22.5 parts by weight |

-continued

| | |
|---|---|
| Ether-type triacrylate represented by the formula $CH_2{=}CHCO{\leftarrow}OC_3H_6{\rightarrow}_l O{-}CH_2$ $CH_2{=}CHCO{\leftarrow}OC_3H_6{\rightarrow}_m OCH_2{-}C{-}CH_2CH_3$ $CH_2{=}CHCO{\leftarrow}OC_3H_6{\rightarrow}_n O{-}CH_2$ $(l + m + n = 3)$ | 27.5 parts by weight. |

Then, the oxygen concentration was adjusted to 300 ppm by substitution with nitrogen, and the coated paper sheet was subjected to electron beam irradiation in the noted atmosphere to a dose of 5 Mrad to provide a support for photographic paper.

EXAMPLE 2

Following the procedure of Example 1, a sheet of paper was coated with the following composition and subjected to electron beam irradiation to provide a support for photographic paper:

| | |
|---|---|
| Titanium dioxide in anatase form | 50 parts by weight |
| Same ether-type diacrylate as used in Example 1 | 20 parts by weight |
| Same ether-type triacrylate as used in Example 1. | 30 parts by weight |

EXAMPLE 3

Following the procedure of Example 1, a sheet of paper was coated with the following composition and subjected to electron beam irradiation to provide a support for photographic paper:

| | |
|---|---|
| Titanium dioxide in anatase form | 50 parts by weight |
| Same ether-type diacrylate as used in Example 1 | 10 parts by weight |
| Same ether-type triacrylate as used in Example 1. | 40 parts by weight |

EXAMPLE 4

Following the procedure of Example 1, a sheet of paper was coated with the following composition and subjected to electron beam irradiation to provide a support for photographic paper:

| | |
|---|---|
| Titanium dioxide in anatase form | 50 parts by weight |
| Same ether-type diacrylate as used in Example 1 | 2.5 parts by weight |
| Same ether-type triacrylate as used in Example 1. | 47.5 parts by weight |

COMPARATIVE EXAMPLE 1

Following the procedure of Example 1, a sheet of paper was coated with the following composition and subjected to electron beam irradiation to provide a support for photographic paper:

| | |
|---|---|
| Titanium dioxide in anatase form | 50 parts by weight |
| Same ether-type diacrylate as used in Example 1 | 30 parts by weight |
| Same ether-type triacrylate as used in Example 1. | 20 parts by weight |

COMPARATIVE EXAMPLE 2

Following the procedure of Example 1, a sheet of paper was coated with the following composition and subjected to electron beam irradiation to provide a support for photographic paper:

| | |
|---|---|
| Titanium dioxide in anatase form | 50 parts by weight |
| Same ether-type diacrylate as used in Example 1 | 0.1 part by weight |
| Same ether-type triacrylate as used in Example 1. | 49.9 parts by weight |

The thus-obtained supports for photographic paper were evaluated for discoloration upon color developing treatment and for resistance to cracking by the methods (i) and (ii) described below, respectively:

(i) Evaluation for discoloration upon color developing treatment:

The brightness (whiteness) after developing treatment was subtracted from that before developing treatment. When the difference was great, the discoloration was regarded as severe, whereas when the difference was small, the discoloration was regarded as slight. The brightness was measured using a Hitachi model 607 color analyzer, and the spectral reflectance at 440 mu was taken as the brightness.

(ii) Evaluation for cracking:

The support was wound round bars differing in diameter with the coated surface outside an observed for occurence or nonoccurrence of cracking by the eye. The crack resistance was evaluated in terms of the diameter of the bar on which cracking occurred. Thus, as the value becomes smaller, the crack resistance becomes higher.

The results obtained are shown in Table 1, from which it is seen that each support for photographic paper as provided by the invention was almost free from discoloration (decrease in brightness) upon color developement treatment and from cracking, and hence quite satisfactory. The supports of Examples 1, 2, 3 and 4 were each subjected to corona discharge treatment, then coated with a silver-gelatin color photographic emulsion, and dried. The thus-obtained color photographic papers showed good photographic behavior (sensitivity, low fog, high resolving power, etc.) and a high degree of gloss.

TABLE 1

| | Ether-Type Diacrylate/ Ether-Type Triacrylate(1) | Evaluation for Discoloration upon Color Developing Treatment(2) (%) | Evaluation for Cracking(3) (cm) |
|---|---|---|---|
| Comparative Example 1 | 60/40 | 10.5 | 0.2 |
| Example 1 (The Invention) | 45/55 | 1.0 | 0.2 |
| Example 2 (The Invention) | 40/60 | 0.2 | 0.2 |
| Example 3 (The Invention) | 20/80 | 0.2 | 0.2 |
| Example 4 (The Invention) | 5/95 | 0.2 | 0.5 |
| Comparative | 0.2/99.8 | 0.2 | 3.0 |

TABLE 1-continued

| | Ether-Type Diacrylate/ Ether-Type Triacrylate(1) | Evaluation for Discoloration upon Color Developing Treatment(2) (%) | Evaluation for Cracking(3) (cm) |
|---|---|---|---|
| Example 2 | | | |

Note:
(1)is Weight ratio,
(2)is Difference in brightness between before and after color developing treatment, and
(3)is Diameter of the bar on which cracking occurred.

While the invention has been described in detail and with reference to specific embodiments thereof, it will be apparent to one skilled in the art that various changes and modifications can be made therein without departing from the spirit and scope thereof.

What is claimed is:

1. A support for photographic paper which comprises a sheet of paper coated with a composition consisting essentially of an unsaturated bond-containing electron beam-polymerizable organic compound (A) and an inorganic white pigment (B), wherein the composition is subjected to electron beam irradiation for curing, wherein said unsaturated bond-containing organic compound (A) and said inorganic white pigment (B) are present in a weight ratio (A)/(B) of from 3/1 to 1/9, and said unsaturated bond-containing organic compound (A) comprises an unsaturated organic compound (C) containing two carbon-to-carbon double bonds per molecule and an unsaturated organic compound (D) containing three carbon-to-carbon double bonds per molecule, and the weight ratio (C)/(D) is from 49/51 to 1/99, wherein the unsaturated organic compound (C) is an ether-type acrylate represented by the formula

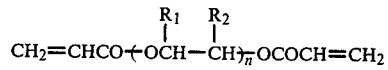

(I)

wherein $R_1$ and $R_2$ each represents —H, —OH, an alkyl group containing from 1 6 carbon atoms, an alkoxy group containing from 1 to 6 carbon atoms, or an aryl group, and is 1 to 15, and wherein the unsaturated organic compound (D) is an ether-type triacrylate represented by the formula

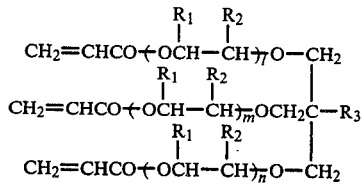

(II)

wherein $R_1$, $R_2$ and $R_3$ each represents —H, —OH, —$CH_2OH$, an alkyl group containing from 1 to 6 carbon atoms, an alkoxy group containing from 1 to 6 carbon atoms, or an aryl group, and l+m+n is from 1 to 20.

2. A support for photographic paper as in claim 1, wherein the ratio (A)/(B) is from 2/1 to ¼ by weight.

3. A support for photographic paper as in claim 1, wherein the ratio (C)/(D) is from 45/55 to 5/95 by weight.

4. A support for photographic paper as in claim 1, wherein the inorganic white pigment (B) has an average grain size greater than 0.1 μm 5. A support for photographic paper as in claim 1, wherein the layer coated has a thickness of from 3 to 100 microns.

* * * * *